United States Patent [19]

Klimeck et al.

[11] Patent Number: 4,773,710

[45] Date of Patent: Sep. 27, 1988

[54] RACK DEVICE FOR ADVANCING A MINING MACHINE

[75] Inventors: Hugo Klimeck, Velbert; Lothar Müller, Bochum, both of Fed. Rep. of Germany

[73] Assignee: Gebr. Eickhoff Maschinenfabrik u. EisengieBerei ubH, Fed. Rep. of Germany

[21] Appl. No.: 73,104

[22] Filed: Jul. 14, 1987

[30] Foreign Application Priority Data

Jul. 17, 1986 [DE] Fed. Rep. of Germany ..... 3624109

[51] Int. Cl.[4] ..... E21C 29/02

[52] U.S. Cl. ..... 299/43; 105/29.1

[58] Field of Search ..... 299/43, 34, 42; 105/29.1; 198/735

[56] References Cited

U.S. PATENT DOCUMENTS 4,082,361 4/1978 Lanfermann ..... 105/29.1 X
4,155,600 5/1979 Lanfermann et al. ..... 299/43
4,184,715 1/1980 Lanfermann ..... 299/43
4,186,970 2/1980 Minke et al. ..... 105/29.1 X

FOREIGN PATENT DOCUMENTS 2646291 4/1978 Fed. Rep. of Germany ..... 299/43
3008959 4/1985 Fed. Rep. of Germany .

*Primary Examiner*—Stephen J. Novosad
*Assistant Examiner*—David J. Bagnell
*Attorney, Agent, or Firm*—Clifford A. Poff; Thomas H. Murray

[57] ABSTRACT

A rack device for advancing a drum cutter mining machine used in underground mining operations. The rack is comprised of a plurality of rack sections positioned end-to-end wherein the discrete sections are held together by brackets which connect two adjacent rack sections. The bracket contains a bracket wall which has a top surface positioned directly beneath the end pins of the discrete rack sections. Force exerted on the rack pins during the translation of the drum cutting mining machine bears upon the bracket wall thereby diminishing damage to the rack structure caused by tilting forces created during translation of the mining machine.

7 Claims, 2 Drawing Sheets

RACK DEVICE FOR ADVANCING A MINING MACHINE

BACKGROUND OF THE INVENTION

1. Field of the Invention

The present invention relates generally to drum cutter mining machines, and more particularly, to a rack device for advancing a drum cutter mining machine used in underground mining.

2. Description of the Prior Art

Drum cutter mining machines utilized in shearing operations in long wall mining procedures are well known. Conventionally, the drum cutter mining machine includes at least one, and usually two, circular cutting drums which, when caused to rotate, shear a mineral from the mine wall proximate to the cutter drums. A rack structure positioned along the mine wall face provides the drum cutter mining machine with a surface upon which translation of the mining machine along the wall face is allowed. U.S. Pat. No. 4,155,599 discloses drive gears which are positioned on the drum cutter mining machine to allow meshing with a rack structure.

U.S. Pat. No. 4,155,600 discloses a rack structure allowing engagement with the drive gears. Also, West German Patent Publication No. DE-PS 3008959 shows a rack structure. The rack structure is comprised of a plurality of movable and immovable rack segments, or sections, positioned end-to-end to provide surfaces allowing translation of a drum cutter machine positioned thereupon. Each rack segment is comprised of two longitudinally extending flat metal members between which discrete rack pins are disposed at a predetermined space from one another. The longitudinally extending flat metal members are of different thicknesses wherein the flat metal member which is positioned away from the mine wall has a thickness greater than the thickness of the flat metal member positioned proximate to the mine wall. The thicker flat metal member contains lug portions at each end thereof wherein the lugs engage with a bracket which is rigidly secured to a section iron of the side bracket of the rack structure. The lugs of the adjacent rack sections are disposed in a recessed portion of the bracket in pairs, and are retained by connecting pins which extend through bore holes extending through the lugs wherein the ends of the connecting pins also engage in bores in bracket walls of the bracket.

In mining operations, the rack segments must be capable of withstanding the forces caused by the weight of the drum cutter, and additionally, must be capable of withstanding the forces created during translation of the mining machine along the rack structure. The rack structures are effectively subjected to substantial tilting forces. Because of the one-sided mounting of the rack in which the thicker flat metal member essentially supports the rack, the tilting forces increase the likelihood that the thin flat metal member may become distorted or otherwise damaged, resulting in considerable impairment of the connection of the rack sections and the bracket.

It is therefore the object of the present invention to provide a rack structure for advancing a drum cutter mining machine which is less susceptible to damage caused by tilting forces created during movement of the mining machine.

SUMMARY OF THE PRESENT INVENTION

In accordance with the present invention, a rack device for advancing a coal-mining machine is disclosed. The rack is comprised of a plurality of a rack sections positioned in tandem wherein each of the rack sections includes a first longitudinally extending track member and a second longitudinally extending track member whereby the two track members are connected theretogether by a series of transversely positioned rack pins. Preferably, the rack pins are disposed at a set spacing from one another to allow meshing engagement with drive gears of the coal mining machine. The first longitudinally extending track member of each rack section includes downwardly extending lugs disposed at the opposite ends of the track member with each lug further containing a bore hole extending therethrough. In the preferred embodiment, the bore hole extending through a lug positioned at a first end of the rack section is circular and the bore hole extending through the lug positioned at a second end of the rack section is elliptical. Connecting pins extend through the bore holes of the lugs, and also connect with bracket walls of a bracket means which receive and hold the lugs of the first track member of adjacent rack sections. One wall of the bracket means abuts at a top surface thereof with at least one rack pin of adjacent rack sections to allow forces exerted upon the rack pins by the coal mining machine to bear upon the bracket wall.

In a further embodiment of the present invention, each rack section further includes a lateral track which extends along the length of the rack section and is positioned so as to bear upon a second bracket wall of the bracket means. Preferably, the laterally extending track is disposed in a plane determined by axes of the transversely positioned rack pin members.

BRIEF DESCRIPTION OF THE DRAWINGS

The invention may be better understood when considered in view of the accompanying drawings in which.

DESCRIPTION OF THE PREFERRED EMBODIMENT

Figure 1:
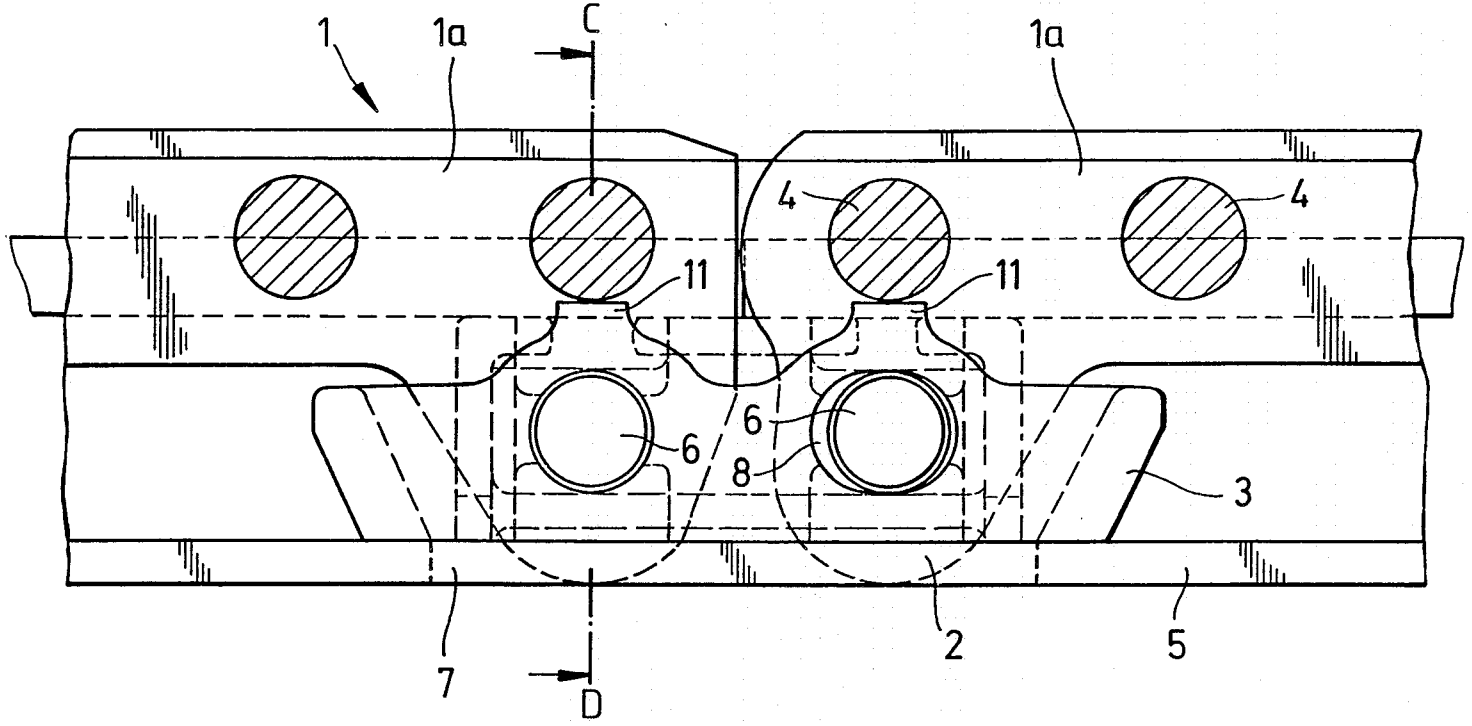
FIG. 1 is a partial side view in elevation of a portion of two rack sections of the rack structure constructed according to the teachings of the present invention, the view being a side elevation sectioned along line A-B of FIG. 2.
Figure 2:
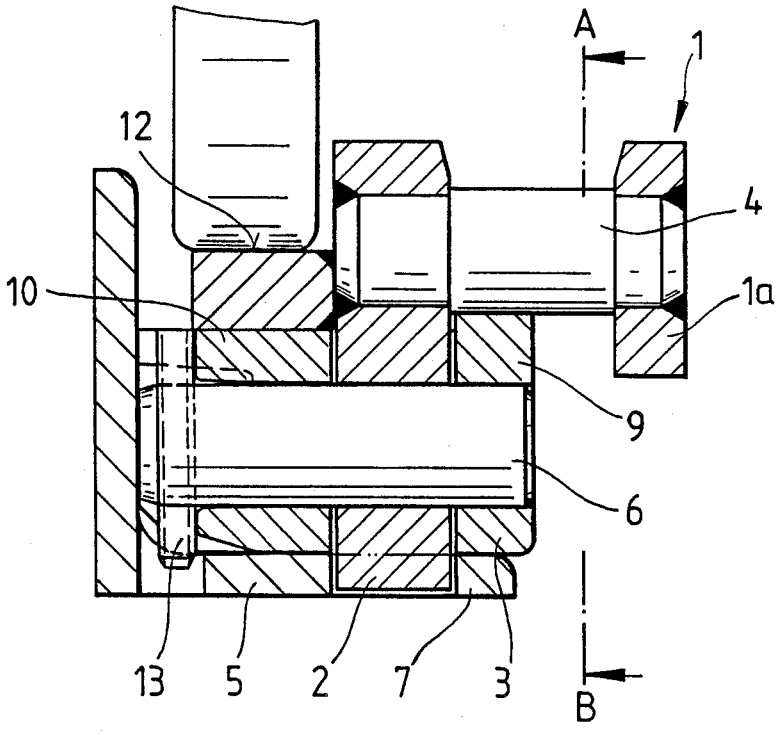
FIG. 2 is a cross sectional view taken along line C-D of the rack structure of FIG. 1.

Referring now to the illustrations of FIGS. 1 and 2, there is shown the rack device of the present invention referred to generally as 1. Rack 1 is comprised of a plurality of discrete sections 1*a* of which portions of two discrete sections 1*a* are illustrated in FIG. 1. The discrete sections 1*a* are positioned in tandem, i.e. end-to-end, in a quantity as required by the length of the wall to be sheared. As best illustrated in the cross-sectional view of FIG. 2, each rack section 1*a* is comprised of two flat metal members of different thicknesses. The thicker metal member contains downwardly extending lugs 2. Positioned between the first and the second flat metal member are rack pins 4 which are disposed at equal distances from one another and are operative to allow the drive gears (not shown) of the drum cutter mining machine to mesh therewith.

Adjacent rack sections 1*a* are engaged with one another by way of the downwardly extending lugs 2 which engage with brackets 3. Brackets 3 overlap two adjoining rack sections 1*a* and contain bracket walls 9 and 10. A side bracket is disposed on the goaf side of the face conveyor (not shown) and contains angle irons 5 to which the brackets 3 are rigidly welded. The discrete rack sections 1*a* of the rack 1 are thereby retained by the side bracket. Interconnecting the rack sections 1*a* and a corresponding bracket 3 are pins 6 which extend transversely to the length of the rack through circular bore holes extending through lugs 2. The pins 6 engage in bores 8 in the bracket and are secured by means of cotters 13. Preferably, the bores 8 extending through the brackets 3 adjoining rack sections 1*a* are of different dimensions. The bore 8 of a first bracket 3 is circular to allow a first section 1*a* to be secured in a pivotal, but non-movable, relation in the recess 7 in the bracket 3 (illustrated in the section 1*a* on the left-hand side of FIG. 1), whereas the bore 8 of the bracket 3 of the other section 1*a* is elliptical to allow limited longitudinal movement.

To prevent the damage caused by the tilting forces which was associated with rack structures of the prior art, the rack device 1 of the present invention is designed such that bracket wall 9 (illustrated in FIG. 2) of bracket 3 contains top surfaces 11 positioned beneath the rack pins 4 which allow the forces bearing upon the rack pin 4 during the translation of the drum cutter mining machine to be transmitted to the bracket wall 9 through bearing surfaces 11. Preferably, top surfaces 11 are disposed below the final end pins 4 of the two adjoining rack sections 1*a* and extend only over a portion of the rack pin diameter. As illustrated in FIG. 1, the surfaces 11 are tangential to the periphery of the end pins 4, and serve as a bearing surface thereby to take up the forces tending to tilt the rack 1.

In a further embodiment of the present invention, laterally extending track 12 (illustrated in FIG. 2) is further included, and extends along the length of each discrete rack section 1*a* and is welded thereto. Track 12 bears at its ends upon bracket wall 10 of a bracket 3 and also functions to prevent the damage caused by the forces tending to tilt the rack 1. Preferably, and as illustrated in FIG. 2, the track 12 is disposed in the plane defined by the longitudinal axes of the pins 4.

While the present invention has been described in connection with the preferred embodiments of the various figures, it is to be understood that other similar embodiments may be used or modifications or additions may be made to the described embodiments for performing the same functions of the present invention without deviating therefrom. Therefore, the present invention should not be limited to any single embodiment, but rather construed in breadth and scope in accordance of the recitation of the appended claims.

We claim as our invention:

1. A rack device for advancing a coal-mining machine, said rack comprising:

a plurality of rack sections positioned in tandem wherein each of said rack sections includes a first longitudinally extending track member and a second longitudinally extending track member, said first and second longitudinally extending track members being spaced apart and connected theretogether by a series of transversly positioned rack pins;

lugs extending beneath opposite ends of said first longitudinally extending track member of each of the rack sections, each of said lugs containing a bore hole extending therethrough;

bracket means positioned beneath said rack sections for receiving and holding said lugs of the first longitudinally extending track members of adjacent rack sections, said bracket means further including bracket walls wherein a first of said bracket walls abuts at a top surface thereof with at least one rack pin of each of the adjacent rack sections to allow forces exerted upon the rack pins by the coal-mining machine to bear upon said bracket wall; and connecting pins extending through said bore holes of the lugs to connect the lugs to the bracket means.

2. The rack device of claim 1 further including a lateral track extending along the length of each of the rack sections, wherein said lateral track is positioned so as to bear at the ends thereof upon a second bracket wall of the bracket means.

3. The rack device of claim 2 wherein said lateral track is disposed in a plane determined by the axes of the transversely positioned rack pin members.

4. The rack device of claim 1 wherein said rack pin members are disposed at a set spacing from one another.

5. The rack device of claim 1 wherein the bore holes extending through said lugs extending beneath opposite ends of the first track member of each of the rack sections includes a circular bore hole extending through a lug at a first end of the rack section and an elliptical bore hole extending through a lug at the opposite end of the rack section.

6. The rack device of claim 5 wherein said connecting pins are of diameters substantially equal to the diameters of the circular bore holes extending through the lugs.

7. The rack device of claim 1 wherein said first bracket wall of the bracket means contains two bearing surfaces, a first bearing surface positioned above a connecting pin of one rack segment, and a second bearing surface positioned above a connecting pin of an adjacent rack segment.

* * * * *